United States Patent [19]

Cunnane, III et al.

[11] 3,941,559

[45] Mar. 2, 1976

[54] ELECTROSTATIC APPLICATION OF DYESTUFFS IN THE DRY STATE

[75] Inventors: Francis J. Cunnane, III, Glenmont, N.Y.; Elizabeth L. Word, Charlottesville, Va.

[73] Assignee: Institute of Textile Technology, Charlottesville, Va.

[22] Filed: May 22, 1974

[21] Appl. No.: 472,092

[52] U.S. Cl. ..... 8/2; 8/2.5 R; 8/175; 68/5 D; 204/134

[51] Int. Cl.[2] ..... D06P 5/20

[58] Field of Search ..... 8/2, 2.5, 175; 96/1 TE

[56] References Cited

UNITED STATES PATENTS

| | | | |
|---|---|---|---|
| 3,454,347 | 7/1969 | Leimbacher | 8/34 |
| 3,782,895 | 1/1974 | Goorhuis | 8/2 |

*Primary Examiner*—M. J. Welsh

*Attorney, Agent, or Firm*—Pennie & Edmonds

[57] ABSTRACT

A method and apparatus for the dyeing of textile fabrics through the electrostatic application of dry dyestuffs is disclosed. The fabric to be dyed is first dampened and then passed between a pair of electrodes which are maintained at a potential difference by an electrostatic generator. A dyestuff is deposited on the bottom electrode and is attracted toward the wet fabric, which bears against the top electrode, through the action of the electrostatic field between the two electrodes. The field causes the dyestuff particles to impinge against the wet fabric, to which the particles become bound. The bottom electrode may also be agitated in order to facilitate the transfer of dyestuff particles to the fabric. The fabric with the dye particles adhering to it is then fixed to complete the dyeing operation by being steamed or dried and heated. The method of the present invention is especially valuable insofar as it results in the more economic use of dyestuffs and an effluent containing quantities of pollutants somewhat lower than those quantities of pollutants found in the effluent of conventional dyeing processes.

20 Claims, 2 Drawing Figures

FIG. 1
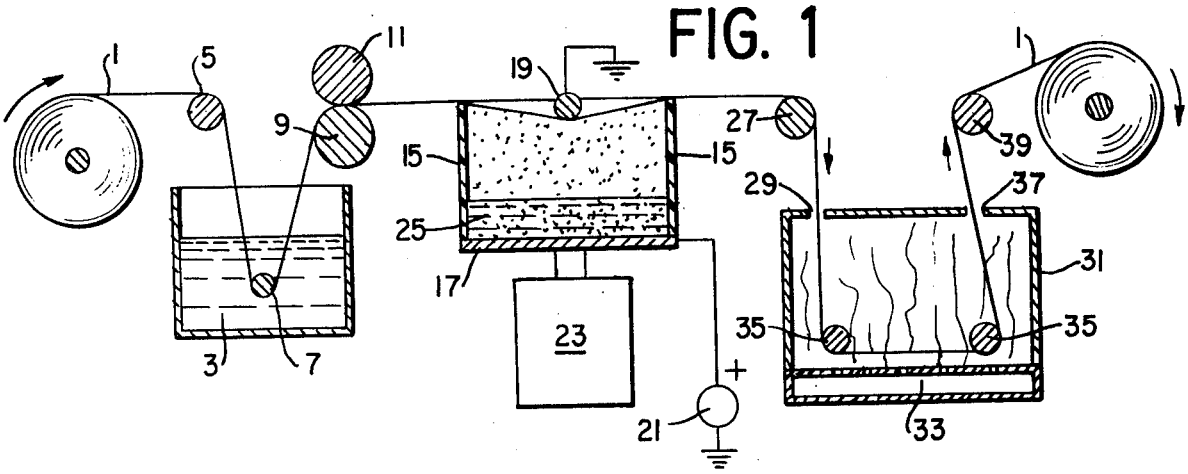
FIG. 2
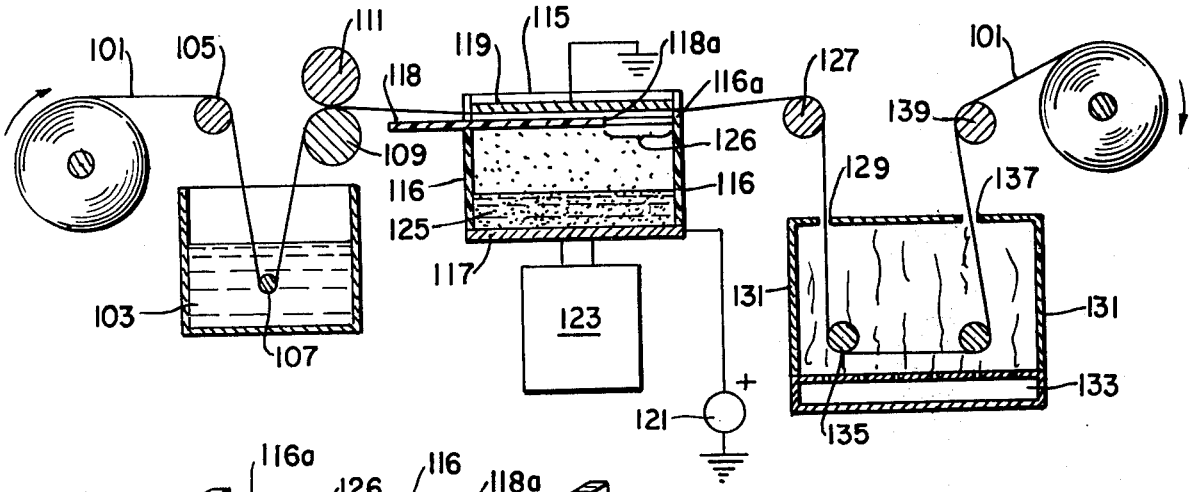
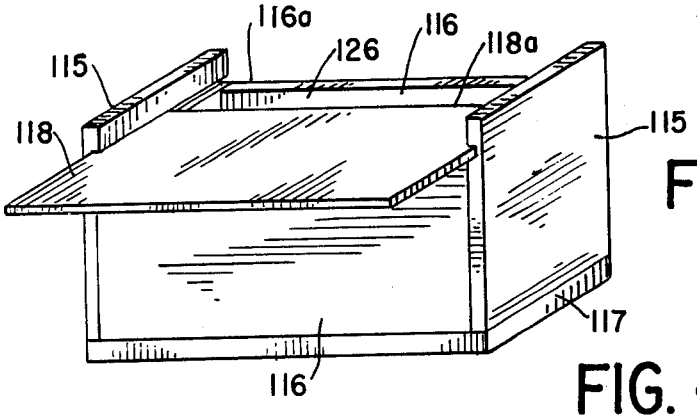
FIG. 3
FIG. 4
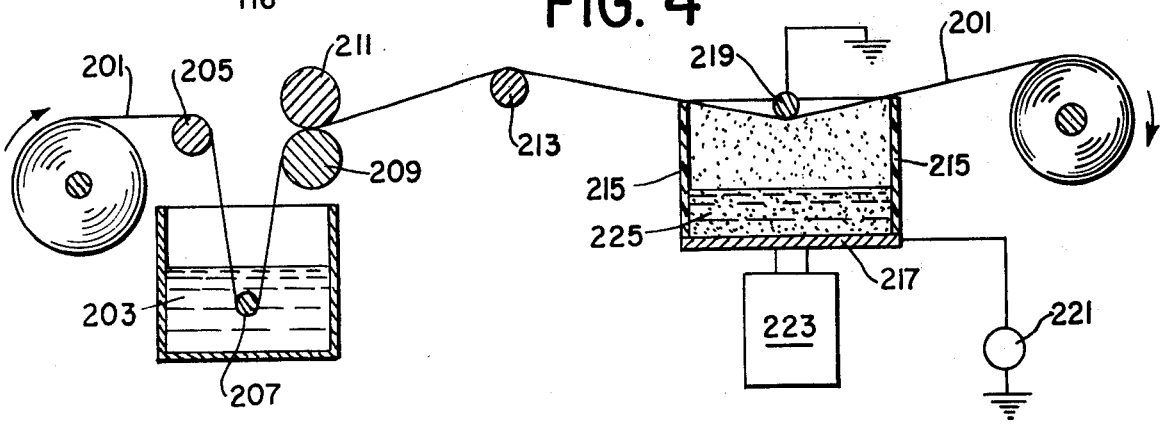

ELECTROSTATIC APPLICATION OF DYESTUFFS IN THE DRY STATE

BACKGROUND OF THE INVENTION

In the dyeing industry, it is customary to color cloth by submerging it in a bath containing a solution of dye maintained at or near the boiling point. The cloth is then taken from the solution and washed to remove the excess dyeing solution still held by the cloth. The color is then fixed using a variety of well-known techniques.

This process, fundamentally unchanged since man first dyed cloth, suffers from a number of serious disadvantages. For example, a great amount of energy is expended in maintaining the bath at or near its boiling point. Another disadvantage is the uneconomical use of the dye. After the dyeing is completed, and the cloth removed from the bath, the remaining bath results in a significant watse of dyeing compound. Still yet another disadvantage in conventional dyeing processes is the amount of pollution created by the disposal of the remaining bath. Any reduction in the quantity of dye discharged is especially important due to the fact that chemical dyes are among the most difficult waste products to treat. The development of clean dyeing techniques has become increasingly important with the passage of the Federal Water Pollution Control Act Amendments of 1972 (Public Law 92-500). This law calls for goals of water quality which are to culminate in zero pollutant discharge by 1985.

Although extensive research is now being carried on with respect to many phases of the dyeing operation, the same basic technique, namely, dissolving the dye in a liquid, applying it to the fabric and fixing it, remains the same. An exception to this general rule has been the attempt to apply dye by vapor-phase dyeing, in which disperse dyes are applied in a gaseous form to various synthetic fabrics. However, the necessity of maintaining elevated temperatures in the presence of a high vaccum rules out this possibility as impractical, at least for the present time.

Although some attempt has been made to color fabric by the electrostatic transfer of specialized dyestuffs, as far as is known, no commercial usage of such a process has resulted. For example, in U.S. Pat. No. 3,454,347, a special dye is prepared by dissolving a dielectic and a coloring agent in a liquid, vacuum drying the liquid and grinding the resulting solid. This dye is then applied to a dry textile which is subsequently sprayed with water.

This type of process suffers from the disadvantage of necessitating the use of a special dye. Additionally, preparation of an acceptable dye for use with such a system involves a number of problems including the selection of a dielectric having quite a few special properties, such as a high electrical resistance and the property of not interfering with the penetration of the dye into the textile fibers. Another problem with such a process is the great quantity of pollutants expelled during the washing operation. The effluent of such a process necessarily contains the dielectric chemical.

In accordance with the present invention, a process far superior to conventional dyeing processes is provided. The above-mentioned inadequacies of prior art dyeing processes are greatly alleviated, resulting in substantial savings. Power requirements, necessary to maintain the dyebath at or near the boil are reduced considerably. Chemicals used to dye the cloth electrostatically are used more efficiently. This results in an effluent containing fewer waste products which must be paid for as well as treated.

Conventional textile dyes are used, and the absence of dielectric from the process results in an effluent free of dielectric pollutants. Use of a conventional dye is thus more economical from the standpoint of dyestuff cost and effluent treatment. Furthermore, there is no dielectric to interfere with the dyeing of the cloth.

SUMMARY OF THE INVENTION

In accordance with the present invention, a new process for the dyeing of fabrics through the electrostatic application of dry dyestuffs is disclosed. Before dyeing, the fabric is wetout. The fabric is then passed between a pair of electrodes, which are disposed one above the other. The dyestuff rests on the bottom electrode which may or may not be mechanically agitated. The bottom electrode is connected to a high-voltage source. Mechanical agitation and the use of high-voltage both contribute to impelling the charged dye particles from the lower electrode into the air and toward the fabric to which they are held. In the preferred embodiment, the wet fabric is maintained at zero electrostatic potential by having it bear against the upper grounded electrode. This has the advantage of maintaining uniformity in the dyeing operation, although more precise control of the fabric could obviate the need for this arrangement. It is also noted that other techniques may be used to transfer the dye to the cloth. For example, a pneumatic transfer system could be used to carry the dye to the cloth. After the fabric has received the dye particles, it is then steamed or dried and heat fixed.

The apparatus of the preferred embodiment of the present invention includes a bath for wetting the fabric. Idlers are provided for guiding the fabric through the bath. Idlers then guide the fabric over a box containing the dye. The bottom of the box conducts electricity while its sides are non-conducting. Disposed above the box is a metallic electrode. A high voltage supply is connected between the two electrodes and serves to charge the particles on the bottom electrode and dye the fabric by carrying the dye toward the wet fabric. The fabric may then be sent to a steam chamber for steaming or it may be dried and heat fixed.

The method and apparatus of the present invention is suitable for the application of virtually all types of dyes. The preferred embodiment shows apparatus for applying dyes of the direct and the disperse types, although any powered dye can be applied using the present invention. Of course, the method of fixation would vary dependent upon the dye used. As in conventional dyeing systems, direct dyes, which are soluable in water, tend to perform better when used to dye cotton and other cellulosic materials. Similarly, the disperse dyes, which are not soluable in water, produce superior results in the case of synthetic fiber. The solution used to wet the fabric is aqueous. The purpose of wetting the fabric is to cause the dye particles to cling to it in order that the dye may be subsequently fixed into the fabric by either steaming, in the case of the direct dyes, or heating, in the case of disperse dyes. After heat fixation, the fabric is scoured and dried. Scouring and drying can be accomplished using a conventional washer and dryer.

The use of a wet fabric bearing against an electrode has been found to yield superior results due to the smoothness of the fabric as it conforms to the shape of the electrode. As mentioned above, other suitable techniques may be used to control the fabric and thereby achieve uniformity in the electrostatic field between the wet fabric and the bottom electrode. Although agitation is used to increase the kinetic activity of the dyestuff particles, similar results may be obtained by reducing the quantity of dye deposited on the bottom electrode and metering in small amounts of dyestuff as needed. It has also been found that, in the case of disperse dyes, satisfactory results can be obtained without the use of an agitator. Some variation in hue can be obtained by varying the surface area of the dyestuff exposed to the fabric.

It is thus seen that, in accordance with the present invention, a technique for the dyeing of textile materials is disclosed which results in the efficient use of dyestuffs and a smaller quantity of pollutants in the effluent discharge of the dyeing operation. The only pollutants encountered are those produced by the scouring operation which releases the small quantity of dye which has not been adequately fixed. Of course, the problem of dye loss due to inadequate fixing is also present in conventional dyeing processes.

BRIEF DESCRIPTION OF THE DRAWINGS

FIG. 1 is a schematic representation of an electrostatic dyeing apparatus constructed in accordance with the present invention;

FIG. 2 is a schematic representation of the dyeing apparatus of the present invention incorporating means for varying the hue of the dyed textile;

FIG. 3 is a perspective view of the dyestuff carrier used in the apparatus illustrated in FIG. 2; and FIG. 4 is a schematic representation of an alternative embodiment of the apparatus of the present invention.

DETAILED DESCRIPTION OF THE PREFERRED EMBODIMENTS

Referring to FIG. 1, an embodiment of the present invention especially useful for dyeing a textile material with a direct dye is illustrated. The textile material 1 passes into wetting solution 3 guided by idlers 5 and 7, which may be rollers or smooth rods. The wetting solution is predominantly water. Various chemical additives may be added to the solution in order to optimize dyestuff dissolution and levelness of application. An anionic dispersing agent such as that marketed under the tradename of Sandopan DTC can be used as an aid in wetting-out the fabric. This agent also has the effect of dispersing the dry dye as it is applied to the wet fabric. Concentrations of Sandopan DTC in the order of 2 ml. per liter have been found to yield acceptable uniformity of fabric wet-out. Of course, a mechanical arrangement may be used to achieve uniform wet-out and thus eliminate the need for a dispersing agent.

After being wet-out, the fabric is passed between a pair of rollers 9 and 11, which remove excess liquid from the wet fabric. The fabric then passes over the dyestuff carrier, which is a box with sides 15, made of non-conducting material, and a conducting base 17. The wet fabric bears against the top of sides 15, sealing the box and thereby preventing the escape and loss of dry dyestuff particles. An upper electrode 19 bears against the wet fabric. This upper electrode is in the form of a metal rod, which has been found to yield most uniform results. By bearing against the wet-out fabric, it smoothes the fabric, thereby creating a uniform field between the upper electrode and fabric and the base electrode 17. The upper electrode 19 is grounded. The base electrode 17 is connected to an electrostatic generator 21. The box made of sides 15 and base electrode 17 is supported by vibrator 23. A quantity of dry dyestuff 25 is disposed in the box.

During operation of the apparatus illustrated in FIG. 1, the box made of sides 15 and base 17 is vibrated by vibrator 23. Typical electrode dimensions may be in the order of 2 inches by 10 inches with a spacing of 2 inches between the electrodes, electrostatic generator 21 should provide about 24 Kv. However, electrode size and spacing as well as applied voltage are not critical and may be varied dependent upon the size of the cloth to be dyed and the spacing between the electrodes. The polarity with which the voltage is applied may also be reversed. The particles of dyestuff are charged by contact with base electrode 17. As the vibrator agitates the dyestuff particles, they are loosened from each other and charged. When the particles are thus charged, they tend to repel each other and form an active bed of dyestuff especially suitable for transfer by the electric field. The particles are then carried upward by the electrostatic field between the upper electrode and the lower electrode by electrostatic generator 21 until they impinge upon the wet fabric 1 and adhere to it.

After the dyestuff is applied to fabric 1, the fabric then passes around idler 27 and through a slit 29 in a box 31. Box 31 serves as a steam chamber for fixing the dye. Box 31 can be made of plywood or any other suitable material and is placed over a steam table 33, which supplies the steam for the fixing operation. During fixing, the fabric 1 is guided by rods 35. After heat fixing, the fabric is then withdrawn through slit 37 and guided around idler 39 after which it is rolled up. A dwell time in the steaming chamber in the order of 20 seconds has been found to be sufficient.

After the fabric has been heat fixed, it may then be unrolled and scoured for about 5 minutes. Such scouring may be done in the manner well known in the industry. After scouring, the finished fabric is dried.

FIGS. 2 and 3 illustrate an alternative embodiment of the invention shown in FIG. 1. The basic operation of the apparatus shown in FIG. 2 is essentially identical to the operation of the apparatus of FIG. 1. Fabric 101 is guided into solution 103 by idlers 105 and 107, and excess solution is removed by pressing the fabric between rollers 109 and 111. The fabric then passes over the dyestuff carrier box comprising grooved side members 115 and non-grooved side members 116 on conducting base 117. The sides are made of a non-conducting material and the base is made of a conductor, such as aluminum.

The wet fabric 101 is adjustably shielded by sliding top 118. Fabric 101 bears against electrode 119. Sliding top 118 is moved back and forth to vary the surface area of fabric 101 exposed to the dyestuff. Electrostatic generator 121 is connected to bottom electrode 117 and supplies the voltage for producing the electrostatic field and charging the dye particles. The dye carrier box may be vibrated by a vibrator 123 in order to impart greater kinetic acitivity to the dyestuff 125 deposited in the box.

When it is desired to vary the hue to which the fabric is dyed, the sliding top 118 is moved to a position corresponding to the desired hue. For darker colors, the aperture 126, defined by the edge 118*a* of top 118 and the top edge 116*a* of one of the sides 116, is maximized.

Similarly, when it is desired to have very pale colors, the width of the aperture must be minimized.

After the dyestuff has been electrostatically applied to the fabric 101, it passes around idler 127 and through slit 129 into steam box 131. Inside the box the steam table 133 supplies steam for the fixing operation. The fabric is supported by rods 135 during the steaming operation. The fabric then passes through slit 137 and around idler 139 after which it is rolled up. The fabric is then scoured and dried using conventional washing and drying machines.

Referring to FIG. 4, apparatus for the application of disperse dyes is illustrated. Generally, it has been found that disperse dyes are much easier to apply than direct dyes. For this reason it is often possible to do away with the vibrator. The superiority of disperse dyes in electrostatic dyeing applications appears to be due to the fact that they are not as cohesive as the direct dyes and tend to be much more active in the electrostatic field.

The fabric 201 is guided into solution 203 by idlers 205 and 207. Solution 203 is water to which a number of additives may be added. It has been found desirable to add Sandopan DTC in concentrations of about 2 ml. per liter to increase the uniformity of fabric wet-out. It has also been found desirable to add a carrier such as Liquid Carolid in concentrations of about 2 ml. per liter. The use of a carrier tends to induce levelness during heat fixation. It may also be found desirable in some processes to introduce a thickener, such as Kelgin in concentrations of about 3 grams per liter.

After the fabric is wet-out, excess liquid is removed by rollers 209 and 211. The wet fabric is then guided by idler 213 to the dyestuff carrier box comprised of sides 215 and bottom 217. In the case of disperse dyes, it has been found necessary to increase the height of the non-conducting sidewalls 215 due to the increased activity of disperse dyestuffs. Upper electrode 219 is grounded and bears against the sidewalls 215, thus sealing the box and preventing the escape of dye particles. Conducting base 217 is connected to an electrostatic generator 221 and may be vibrated by mechanical agitator 223. However, it has been found that with disperse dyes, satisfactory transfer of dye can be obtained without the use of mechanical agitation because the strength of the electrostatic field between the wet cloth and the base 217 is sufficient to perform the desired transfer of dyestuff particles to the wet fabrics. As the fabric passes over the dyestuff carrier box, dyestuff particles are conveyed upward by the electrostatic field until they contact the fabric and adhere to it.

After the dyestuff has been applied to the fabric, the fabric is then rolled up and heat fixed by being heated and dried in accordance with techniques well known in the industry for finishing the dyeing of fabrics with disperse dyes. The fabric is then scoured and dried using conventional techniques.

I claim:

1. A process for the dyeing of a fabric, comprising the steps of:

a. wetting the fabric by passing the fabric through a liquid bath;

b. applying dry dyestuffs to the wet fabric; and c. fixing the applied dyestuffs.

2. A process for the dyeing of a fabric comprising the steps of:

a. wetting the fabric by passing the fabric through a liquid bath;

b. passing the wet fabric between an upper electrode and a lower electrode having the dyestuff deposited on it;

c. maintaining said upper and lower electrodes at a potential difference with respect to each other to electrostatically apply dry dyestuffs to the wet fabric; and d. fixing the applied dyestuffs.

3. A process as in claim 2, further comprising the step of vibrating the lower electrode as the fabric passes between said electrodes.

4. A process as in claim 3, wherein the wet fabric bears against the upper electrode.

5. A process as in claim 2, wherein the wet fabric bears against the upper electrode and further comprising the step of vibrating the lower electrode as the fabric passes between said electrodes.

6. A process as in claim 5, wherein said applied dyestuffs are fixed by being passed through a steam chamber.

7. A process as in claim 5, wherein said applied dyestuffs are fixed by being heated.

8. A method for dyeing textile fabric, comprising the steps of:

a. passing the textile fabric through a liquid bath to wet-out the fabric;

b. removing excess liquid from the fabric by pressing it between a pair of rollers;

c. providing an electric field;

d. introducing dyestuff particles into said field, said field acting to move the particles;

e. passing the fabric through said electrostatic field, whereby the particles are moved toward the wet fabric and are transferred to said wet fabric; and f. fixing the dye by passing the fabric through a chamber filled with steam.

9. A method as in claim 8 further comprising means to maintain a constant distance between the introduced dyestuff particles and said textile fabric.

10. A process for the dyeing of a fabric comprising the steps of:

a. wetting the fabric;

b. applying a dry dyestuff to the wet fabric by impelling dry dyestuff particles against the wet fabric, causing dry dyestuff particles to adhere to the fabric; and c. fixing the applied dyestuffs.

11. A process for the dyeing of a fabric comprising the steps of:

a. wetting fabric;

b. applying a dry dyestuff to the wet fabric by impelling dry dyestuff particles against the wet fabric by means of an electrical field, causing dry dyestuff particles to adhere to the fabric; and c. fixing the applied dyestuffs.

12. A process as in claim 11, wherein the dye is applied to the wet fabric by passing the wet fabric between a first electrode and a second electrode, maintaining said first and second electrode at a potential difference, and introducing said dry dyestuff particles between said wet fabric and one of said electrodes.

13. A process as in claim 12, wherein said first electrode is an upper electrode and said second electrode is a lower electrode and the dyestuff is introduced by being deposited on the lower electrode.

14. A process as in claim 13, wherein the lower electrode is vibrated.

15. A process as in claim 12, wherein the wet fabric bears against an element disposed on the side of the fabric opposite the dyestuff.

16. A process as in claim 15, wherein said element is the first electrode.

17. A process as in claim 16, wherein said first electrode is an upper electrode and said second electrode is a lower electrode and the dyestuff is introduced by being deposited on the lower electrode.

18. A process as in claim 17, further comprising the step of vibrating said lower electrode as the fabric passes between the electrodes.

19. A process as in claim 18, wherein said applied dyestuffs are fixed by being passed through a steam chamber.

20. A process as in claim 18, wherein said applied dyestuffs are fixed by being heated.

* * * * *